United States Patent [19]

Seifert

[11] Patent Number: 4,526,323

[45] Date of Patent: Jul. 2, 1985

[54] FUEL INJECTION NOZZLE FOR INTERNAL COMBUSTION ENGINES

[75] Inventor: Kurt Seifert, Esslingen-Zollberg, Fed. Rep. of Germany

[73] Assignee: Robert Bosch GmbH, Stuttgart, Fed. Rep. of Germany

[21] Appl. No.: 380,376

[22] Filed: May 20, 1982

[30] Foreign Application Priority Data

May 20, 1981 [DE] Fed. Rep. of Germany ..... 3120044
Aug. 1, 1981 [DE] Fed. Rep. of Germany ..... 3130621

[51] Int. Cl.[3] ..... B05B 1/32

[52] U.S. Cl. ..... 239/453; 239/533.4; 239/533.9

[58] Field of Search ..... 239/533.3–533.12, 239/453

[56] References Cited

U.S. PATENT DOCUMENTS 2,063,709 12/1936 Taylor ..... 239/453
4,394,972 7/1983 Potter ..... 239/533.12

FOREIGN PATENT DOCUMENTS 1040381 10/1953 France ..... 239/533.3
356288 1/1938 Italy ..... 239/533.11
476239 12/1952 Italy ..... 239/533.5
505084 12/1954 Italy ..... 239/533.3
47104 2/1919 Sweden ..... 239/533.3
633857 12/1949 United Kingdom ..... 239/533.5

*Primary Examiner*—John J. Love
*Assistant Examiner*—Michael J. Forman
*Attorney, Agent, or Firm*—Edwin E. Greigg

[57] ABSTRACT

A fuel injection nozzle for internal combustion engines having a hollow needle in which a valve needle is displaceably supported, which cooperates with an internal valve seat of the hollow needle. Associated with the valve needle are a valve spring and a stop attached to the housing, which restrain the valve needle with respect to the hollow needle as it moves in the opening direction, thus opening the valve. The closing movement of the hollow needle is limited by a stop on the nozzle body, which with a counterpart shoulder on the hollow needle efficaciously forms a shield with respect to the combustion chamber for the bearing gap between the hollow needle and the nozzle body. The hollow needle may advantageously be embodied as a closing member opening outward and cooperating with the nozzle body in order to control further injection openings. The injection nozzle has the advantage that operation is possible without leaking oil, with two injection hole cross sections being opened in a time-controlled manner effected via the needle stroke.

20 Claims, 4 Drawing Figures

FUEL INJECTION NOZZLE FOR INTERNAL COMBUSTION ENGINES

BACKGROUND OF THE INVENTION

The invention is based on a fuel injection nozzle for internal combustion engines. Injection nozzles of this kind are distinguished by the fact that the downstream section of the fuel conduit adjoining the valve seat, which serves to effect further fuel preparation and formation of the injection stream, can be embodied and dimensioned with relative freedom of choice, without being hindered by a closing member, and furthermore by the fact that the fuel is carried all the way through the chamber intended for the disposition of the closing spring, so that no particular provisions have to be made for preventing or eliminating leaking oil from the cylinders. These injection nozzles thus combine the advantages of nozzles having an inwardly opening valve needle (called I-nozzles) with those of nozzles having an outwardly opening valve needle (A-nozzles), yet they do not have the disadvantages of either type.

In the known injection nozzles of the general type discussed above, the hollow needle is supported in the closing position on the valve needle via the valve seat, while the valve needle in turn rests on a shoulder attached to the housing. In order to restrain the valve needle with respect to the hollow needle as the hollow needle moves in the opening direction, the valve needle is pressed by a spring against the shoulder attached to the housing. In this known embodiment, the valve seat is stressed relatively severely, and furthermore, when the valve is in the open position, a precise position of the valve needle with respect to the hollow needle is not assured, because the valve needle is held against the stop attached to the housing only by tensional engagement. It also appears to be disadvantageous that the bearing gap between the hollow needle and the nozzle body, in the closing position of the valve, is not shielded from the combustion chamber of the engine, so that the ability of the hollow needle to slide may become impaired over the course of time.

OBJECT AND SUMMARY OF THE INVENTION

The apparatus according to the invention has the advantage over the prior art that the valve seat is no longer stressed by the closing spring which acts on the hollow needle; instead, it is stressed by the valve spring which presses against the valve needle. It is possible for this valve spring to be much smaller in dimension than the closing spring.

Furthermore, in the open position of the valve, an exact position of the valve needle relative to the hollow needle is assured because this position is determined by two shoulders attached to the housing, that is, by positive engagement rather than tensional engagement.

By means of the characteristics recited herein, advantageous further embodiments of the apparatus disclosed can be attained.

It is particularly advantageous if the stop shoulder for the hollow needle and its counterpart shoulder are embodied with faces which in the closing position of the hollow needle seal off their bearing gap from the nozzle body or shield their gap from the combustion chamber. In this case, the bearing gap between the hollow needle and the nozzle body in the closing position of the hollow needle is shielded from the engine combustion chamber, assuring that the guidance of the hollow needle within the nozzle body will be satisfactory over a long period of time.

With the characteristics set forth below, a simple structure of the injection nozzle which is well engineered for mass producing can be attained.

In a further embodiment of the invention, the hollow needle can be embodied as a closing member, cooperating with the nozzle body and opening outward, for controlling further injection holes. This arrangement is particularly advantageous in the case of hole-type nozzles and pintle nozzles whose cross secction is controlled in accordance with the valve stroke. The passage of fuel can be embodied freely downstream of the valve seat or seats, and in particular it may be distributed among a multiplicity of injection holes or groups of injection holes, the cross section and direction of which can be adapted to the requirements of a particular usage.

In accordance with features set forth herein, the hollow needle can, with the nozzle body, control a first injection hole cross section and, with the valve needle, it can control a second injection hole cross section. The means for restraining the valve needle with respect to the hollow needle as it moves in the opening direction can be disposed such that they come into action directly following the beginning of the opening movement of the hollow needle. In this case, the injection hole cross section controlled by the hollow needle and the valve needle is opened first, while the other injection hole cross section is opened only after the hollow needle has executed part of its stroke.

The sequence of injection may also be controlled such that the means for restraining the valve needle first come into action only after a first partial stroke of the hollow needle, corresponding to a pre-injection phase. Thus it is attained that the first injection hole cross section disposed further toward the edge of the combustion chamber is opened by the hollow needle first, and that the second injection hole cross section disposed further toward the center of the combustion chamber is opened by the valve needle only at the beginning of the main injection phase. It is further attained that after the hollow needle has executed its first partial stroke, the closing pressure increases along with the injection quantity, and thus the fuel presure prevailing ahead of the valve also increases abruptly; the result is that in the partial-load and full-load range of the engine, very satisfactory preparation of the fuel is assured.

If the hollow needle is embodied in accordance with features set forth herein, the result is that the second injection hole cross section assumes the function of a conventional hole-type nozzle having a valve needle opening inward, without there being any need to make provisions for eliminating leaking oil.

The hollow needle may efficaciously be embodied in other features set forth and may control a plurality of injection holes, together forming the first injection hole cross section, in the nozzle body.

It is possible to have an embodiment without injection holes in the nozzle body if the first injection hole cross section is embodied by transverse bores in the hollow needle, which exit from the guide bore of the nozzle body after the hollow needle has executed a partial stroke.

In an injection nozzle embodied in accordance with other features, the combustion gases are also kept away from the fixed valve seat on the nozzle body when the hollow needle is in the closing position.

The invention will be better understood and further objects and advantages thereof will become more apparent from the ensuing detailed description of preferred embodiments taken in conjunction with the drawing.

BRIEF DESCRIPTION OF THE DRAWINGS

Four exemplary embodiments of the invention are shown in the drawing and described in greater detail below.

DESCRIPTION OF THE PREFERRED EMBODIMENTS

Figure 1:
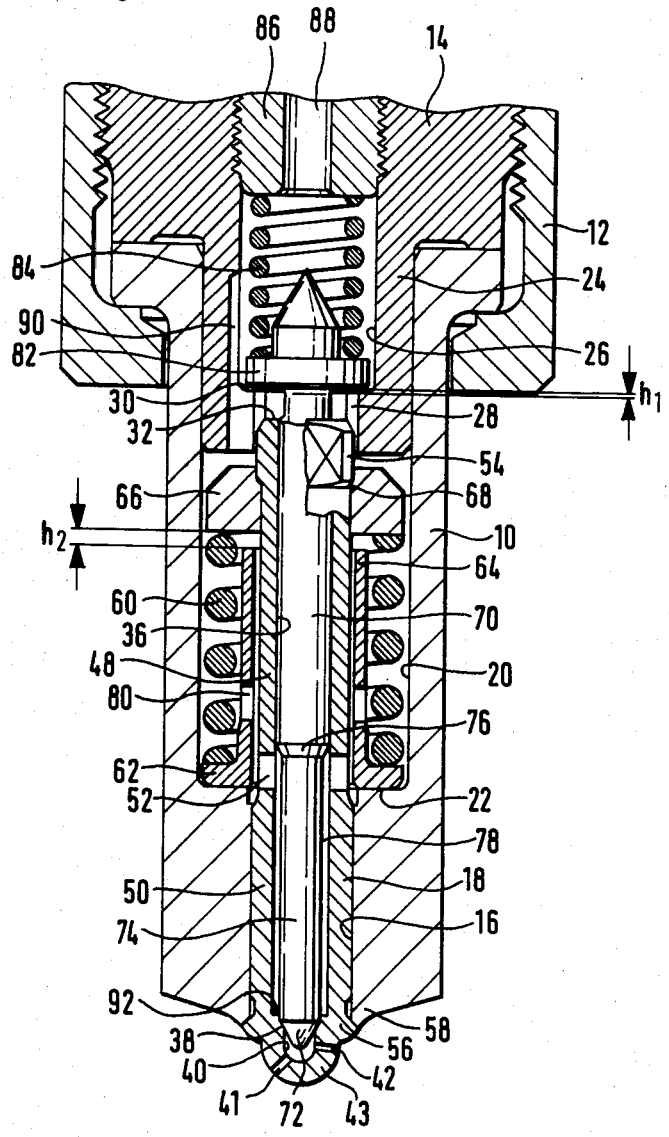
FIG. 1 is a partial sectional view taken through one embodiment of the invention.

The injection nozzle shown in FIG. 1 has a nozzle body 10 firmly fastened to a nozzle holder 14 by means of a screw body 12. In the nozzle body 10, there is a guide bore 16 for a hollow needle 18 and a bore 20 of larger diameter, which at a shoulder 22 merges with the guide bore 16. A nozzle holder 14 includes a protrusion 24 which protrudes with a tight fit into the bore 20 in nozzle body 10. The protrusion 24 is provided with a bore 26 and, at one end, with a smaller opening 28 whose cross section has two faces. As a result, a shoulder 30 on the protrusion 24 remote from the injection end of the nozzle is formed, having a circumferential bearing surface.

The hollow needle 18 has a longitudinal bore 36 beginning at its upper end 32 and leading as far as a conical valve seat 38 in hollow needle 18; adjoining the valve seat 38 downstream, in the end of the hollow needle which is embodied as a tapered tip 43, is a blind bore 40 having outward-leading injection holes 41, 42.

The hollow needle 18 is provided with a linear section 48 of slightly reduced outer diameter; in the vicinity of its transition to a larger diameter section 50 of undiminished diameter guided within the nozzle body 10, this section 48 has a transverse bore 52. At the top, the section 48 is adjoined by a larger diameter head 54 having two faces; the head protrudes into the opening 28 in the protrusions 24 in a fitting manner with the two faces on the end thereof but with the necessary play to allow movement and secures the hollow needle 18 so that it will not rotate.

On the outer circumference of the hollow needle 18, in the vicinity of the valve seat 38, there is also a conical, annular shoulder 56, which cooperates with a correspondingly shaped counterpart shoulder 58 at one end of the nozzle body 10. A closing spring 60 is disposed in the bore 20 of nozzle body 10 and is supported at the bottom on a flange 62 of a bushing 64, the flange resting on the shoulder 22; the bushing 64 surrounds a portion of the reduced diameter section 48 of the hollow needle 18 with some play. At the upper end, the closing spring 60 engages a pressure ring 66, which pushes against an annular shoulder 68 of the hollow needle 18 formed between the section 48 and the head 54. The upward stroke (closing stroke) of the hollow needle 18 effected by the closing spring 60 is limited by the shoulders 56 and 58 on the lower end of the hollow needle 18 and the nozzle body 10, which are embodied as valve faces and in the closing position of the hollow needle 18 seal off the bearing gap formed between the hollow needle and the nozzle body from the combustion chamber.

In the bearing bore 36 of the hollow needle 18, a valve needle 70 is displaceably guided which at the end toward the injection location has a sealing cone 72 cooperating with the valve seat 38. The sealing cone 72 is formed on a section 74 of the valve needle 70 of somewhat reduced diameter, which at a shoulder 76 merges with a larger diameter section of the valve needle 70 whose diameter is undiminished. The shoulder 76 is located somewhat above the transverse bore 52 in the hollow needle 18, so that the annular chamber 78 formed between the reduced diameter section 74 of the valve needle 70 and the wall of the longitudinal bore 36 in the hollow needle 18 communicates with the bore 20 in the nozzle body 10 via the transverse bore 52, the annular play between the hollow needle 18 and bushing 64, and one or more transverse bores 80 in the bushing 64.

The valve needle 70 protrudes part-way out of the hollow needle 18 at the top and there is provided with an annular collar 82, the upper end of which is engaged by a valve spring 84 supported on a threaded bushing 86 threaded into the bore 26. The valve spring 84 has the tendency to urge the valve needle 70 toward the valve seat 38 in the hollow needle 18. This is accomplished in the closing position of the hollow needle 18 which is shown in the drawing; in this position, the collar 82 of the valve needle 70 is still remote from the shoulder 30 on the nozzle holder 14 by the distance of the stroke $h_1$. Once the hollow needle 18 has covered the distance $h_1$ in the opening direction, the collar 82 rests on the shoulder 30; the valve needle 70 is now prevented from making any further movement together with the hollow needle 18. The total stroke $h_2$ of the hollow needle 18 is limited by the bushing 64, on the upper end of which the pressure ring 66 comes to rest.

The threaded bushing 86 is provided with a bore 88 for carrying the fuel. The path of the fuel leads to the bore 20 via the bore 26 and a peripheral recess 90 in the protrusion 24 of the nozzle holder 14 which bypasses the shoulder 30; from the bore 20, the fuel acts upon the end 32 of the hollow needle 18 and exerts a force in the direction toward the combustion chamber which is counter to that of the closing spring 60. From the bore 20, the fuel passes via the transverse bore 52 in the hollow needle 18 into the annular chamber 78 between the hollow needle 18 and the valve needle 70; there the fuel exerts a further force upon the hollow needle 18 via the narrow annular face 92 above the valve seat 38. The fuel also exerts a resultant downward force on the valve needle 70, which reinforces the valve spring 84 in forcing the valve needle 70 against the valve seat 38.

As the fuel pressure increases at the beginning of an injection stroke, the hollow needle is moved downward out of the nozzle body 10, as the closing spring 60 is compressed. The valve needle 70 can follow up this movement, under the influence of the valve spring 84 and of the fuel pressure, only for the short distance of the stroke $h_1$; subsequently, the collar 82 strikes the shoulder 30 and necessarily causes a relative movement on the part of the valve needle 70 with respect to the hollow needle 18, which continues to move. This relative movement has approximately the same effect, in terms of the fuel control in the area where fuel is ejected, as that of a valve needle moving inward when there is a fixed valve seat. In comparison with injection nozzles having that kind of function (inwardly opening needles or I-nozzles), however, the described apparatus has the advantage that any flow of leaking oil does not impair the guidance of the valve needle 70 or of the hollow needle 18 or else such a flow does not occur, and thus it is not necesary to provide any means for eliminating such a flow.

Once the fuel pressure drops at the end of an injection stroke, the closing spring 60 restores the hollow needle 18 to its outset position, in which it strikes the shoulder 58 of the nozzle body 10 with its shoulder 56. The two shoulders 56 and 58 thereafter form a valve-like closure, which prevents the combustion gases from gaining access to the bearing gap between the hollow needle 18 and the nozzle body 10. Shortly before the shoulder 56 comes to rest on the shoulder 58, the valve needle 70 arrives at the valve seat 38, after which the exit of fuel from the injection holes 41, 42 is interrupted. The valve needle 70 thereafter is above the shoulder 30 by the distance of the stroke $h_1$. The stroke $h_1$ has been dimensioned such that it is precisely large enough, taking into consideration the tolerances required during manufacture, that the valve needle 70 in the closing position of the hollow needle 18 can reliably come to rest against the valve seat 38.

Figure 2:
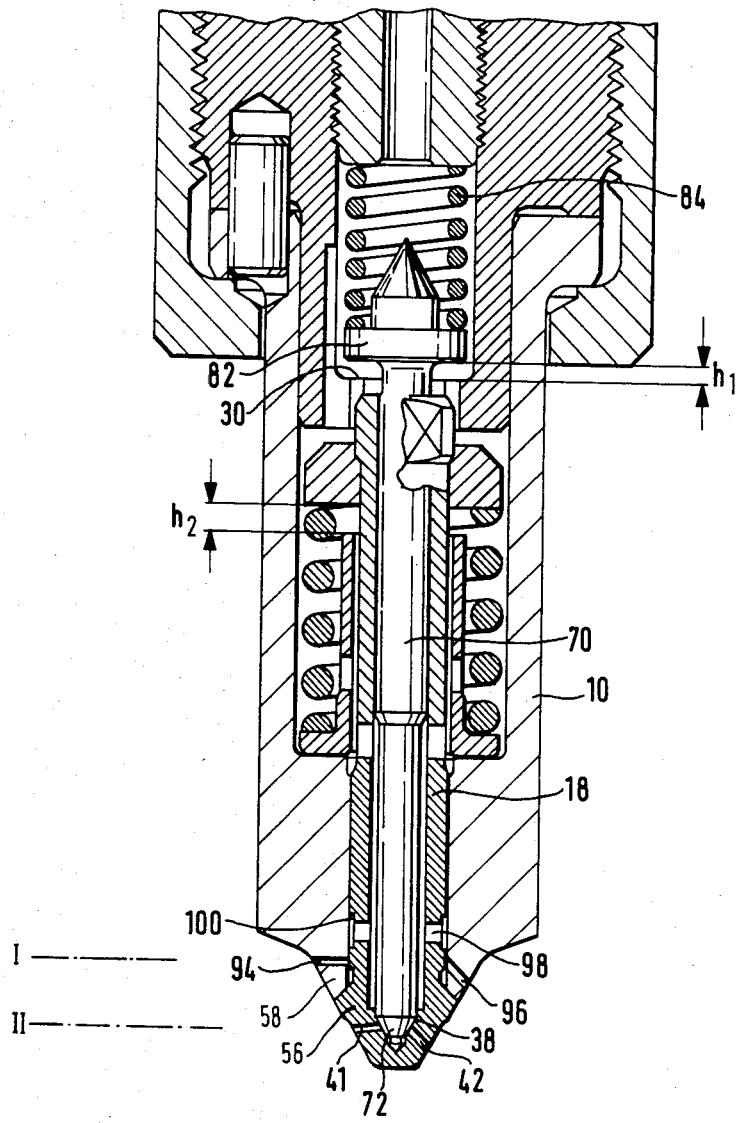
FIG. 2 is a partial sectional view of a modification of the nozzle of FIG. 1.

The exemplary embodiment of FIG. 2 agrees with that of FIG. 1 in all the details described thus far, except that the hollow needle 18 in this second embodiment itself embodies the closing member for a valve device which controls a second group of injection holes 94 and 96 extending within the nozzle body 10. The hollow needle 18 is provided to this end with a transverse bore 98 and an annular groove 100 in the jacket circumference, into which the transverse bore discharges at either end. The collar 82 of the valve needle 70 in this embodiment is remote from the shoulder 30 attached to the housing by the distance of the partial stroke $h_1$, which now serves the purpose not only of eliminating manufacturing tolerances as a factor but also of controlling the two groups 41, 42 and 94, 96 of injection holes in accordance with the stroke.

Upon the opening stroke of the hollow needle 18, first the injection holes 94 and 96, which taken as a whole provide a first injection hole cross section I, are opened via the annular groove 100, while the valve spring 84 keeps the valve needle 70 in contact with the valve seat 38 of the hollow needle 18. During the continuing course of the opening stroke of the hollow needle 18, the valve needle 70 is restrained relative to the hollow needle; as a result, the injection holes 41, 42, which taken as a whole provide a second injection hole cross section II, are also opened. At the end of the injection procedure, the same events occur in reverse order. The apparatus could also, by appropriately selecting the distance between the transverse bore 98 and the sealing cone 72 on the valve needle 70, be such that first the sealing cone 72 would rise from the valve seat 38 and only then would the second group 94, 96 of injection holes be opened.

The injection nozzle of FIG. 2 also has the advantage that upon the opening of the injection holes 41, 42 or the second injection hole cross section II and with the associated abrupt enlargement of the total injection hole cross section, an abrupt pressure increase in the closing force also occurs, being caused by the absorption of the force of the valve spring 84; this advantageously assures that the fuel is thereafter prepared and atomized equally well as is the case during the first partial stroke $h_1$.

Figure 3:
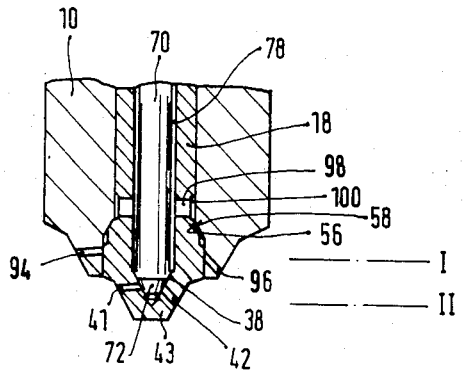
FIG. 3 is a partial sectional view of a second modification.

The exemplary embodiment of FIG. 3 differs from the above embodiments solely in that the shoulder 56 of the hollow needle 18 is disposed upstream of the first injection hole cross section I and cooperates with an inner shoulder 58 of the nozzle body 10. In this embodiment, it is true that the bearing gap between the hollow needle 18 and the nozzle body 10 is shielded in the closing position of the hollow needle 18 from the combustion chamber. However, it is advantageous that the shoulders 56 and 58, which in the closing position cooperate in valve-like fashion, additionally seal off the annular chamber 78 from the first injection hole cross section I.

If it is possible to do without the additional advantage of the abrupt pressure increase after the first partial stroke of the hollow needle 18, then the sequence of injection relating to the injection hole cross sections I and II can also be reversed.

Figure 4:
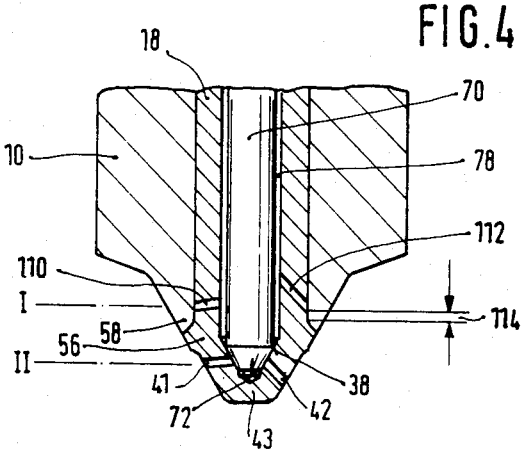
FIG. 4 is a partial sectional view of another modification.

The exemplary embodiment of FIG. 4 is a further modification of the exemplary embodiment of FIG. 2. The injection hole cross section I here is embodied by injection holes 110 and 112 in the hollow needle 18, which in the closing position of the hollow needle 18 are sealed off from the combustion chamber by means of an overlap 114 and by means of the valve seat formed between the shoulders 56 and 58 on the hollow needle 18 and nozzle body 10. When the hollow needle 18 moves in the opening direction, the injection holes 110 and 112 exit from the guide bore within the nozzle body 10, so that the conduits 46, 47 in the nozzle body 10 which were provided in the injection nozzle of FIG. 2 are superfluous here.

The injection nozzle of FIG. 4 also has the advantage that the injection hole cross section I in the closing position of the hollow needle 18 is additionally sealed off by the valve seat formed between the shoulders 56 and 58. The sequence of opening of the injection hole cross sections I and II can be selected arbitrarily by adapting the prestroke $h_1$ and the overlap 114 to one another.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines, a nozzle body, said nozzle body including a guide bore at one end and a larger diametic bore, a nozzle holder including a protrusion end which extends into said larger diameter bore of said nozzle body, a hollow needle in said guide bore and extending into said larger diameter bore of said nozzle body, a fuel inlet for admitting fuel into said nozzle holder and said larger diameter bore of said nozzle body, said hollow needle displaceable by the pressure of the fuel in its flow direction, a closing spring which applies a counterforce on said hollow needle by use of a pressure ring, in which said hollow needle includes an internal valve seat to prevent fuel flow through an outlet in said hollow needle, a valve needle within said hollow needle cooperating with and displaceably supported relative to the valve seat to form a valve, further including means for retaining said valve needle with respect to said hollow needle which means moves in the opening direction in order to open said valve, said valve needle having a reduced diameter portion that permits fuel flow from said larger diameter bore of said nozzle body to said outlet, a stop shoulder on said nozzle body for supporting said hollow needle to absorb the closing spring force in the closing position of the valve, said valve needle is urged in the flow direction of the fuel by a valve spring and is pressed against the valve seat in the closing position of the hollow needle, and said protrusion end of said nozzle holder includes a shoulder which restrains the valve needle with respect to the hollow needle as said valve needle moves in the opening direction in order to limit the movement of said valve needle.

2. A fuel injection nozzle as defined in claim 1, characterized in that said stop shoulder for the hollow needle and a counterpart shoulder on said hollow needle are embodied as valve faces, which in the closing position of the hollow needle seal off any gap between said valve faces and shield any bearing gap from a combustion chamber of said internal combustion engine.

3. A fuel injection nozzle as defined by claim 2, in which the hollow needle is embodied as a closing member which opens outward relative to said nozzle body and cooperates with the nozzle body, in order to control further injection openings.

4. A fuel injection nozzle as defined by claim 3, characterized in that the means for restraining the valve needle with respect to the hollow needle moving in the opening direction comes into action once the hollow needle has executed a first partial stroke in the opening direction corresponding to a pre-injection phase.

5. A fuel injection nozzle as defined by claim 4, in which the hollow needle has a conical valve seat and the valve needle has a sealing cone, and that the end of the hollow needle oriented toward the injection location is embodied as a tapered tip in the manner of a blind bore in which tip the injection holes forming the second injection hole cross section are provided.

6. A fuel injection nozzle as defined by claim 4, characterized in that a valve seat attached to the housing and controlled by the hollow needle is formed by means of a wall section of the nozzle holder tightly guiding the hollow needle, in the vicinity of which wall section a group of injection holes forming the first injection hole cross section discharges into the guide bore for the hollow needle.

7. A fuel injection nozzle as defined by claim 2 in which the fuel supply passage extends all the way through the protrusion of said nozzle holder and includes therein said valve spring.

8. A fuel injection nozzle as defined by claim 2, in which an opening stroke ($h_2$) of the hollow needle is limited by said pressure ring seating on a bushing surrounding the hollow needle with play and shielding it from said closing spring.

9. A fuel injection nozzle as defined by claim 2, in which said valve needle has an annular collar on an upper end section that protrudes out from the hollow needle, one face of said annular collar is engaged by said valve spring and the other face supported by said shoulder on said protrusion end of said nozzle holder when moved in a downward direction by fuel pressure.

10. A fuel injection nozzle as defined by claim 2, in which the hollow needle downstream of the valve seat has a blind bore, from which injection holes forming said outlet lead to the outside of said injection nozzle.

11. A fuel injection nozzle as defined by claim 1 in which the fuel supply passage extends all the way through the protrusion of said nozzle holder and includes therein said valve spring.

12. A fuel injection nozzle as defined by claim 1 in which an opening stroke ($h_2$) of the hollow needle is limited by said pressure ring seating on a bushing surrounding the hollow needle with play and shielding it from said closing spring.

13. A fuel injection nozzle as defined by claim 1 in which said valve needle has an annular collar on an upper end section that protrudes out from the hollow needle, one face of said annular collar is engaged by said valve spring and the other face supported by said shoulder on said protrusion end of said nozzle holder when moved in a downward direction by fuel pressure.

14. A fuel injection nozzle as defined by claim 1 in which the hollow needle downstream of the valve seat has a blind bore, from which injection holes forming said outlet lead to the outside of said injection nozzle.

15. A fuel injection nozzle as defined by claim 1, in which the hollow needle is embodied as a closing member which opens outward relative to said nozzle body in order to control further injection openings.

16. A fuel injection nozzle as defined by claim 15, in which the hollow needle operates relative to a value seat on said nozzle body to control a first injection hole cross section and operates relative to said valve needle to control a second injection hole cross section.

17. A fuel injection nozzle as defined by claim 16, in which the hollow needle has a conical valve seat and the valve needle has a sealing cone, and that the end of the hollow needle oriented toward the injection location is embodied as a tapered tip in the manner of a blind bore, in which tip the injection holes forming the second injection hole cross section are provided.

18. A fuel injection nozzle as defined by claim 16, in which a valve seat attached to the housing and controlled by the hollow needle is formed by means of a wall section of the nozzle holder tightly guiding the hollow needle, in the vicinity of which wall section a group of injection holes forming the first injection hole cross section discharges into the guide bore for the hollow needle.

19. A fuel injection nozzle as defined by claim 16, in which the first injection hole cross section is formed by transverse bores in the hollow needle, which after a partial stroke of the hollow needle exit from the guide bore of the nozzle body.

20. A fuel injection nozzle as defined by claim 2, 16, in which the stop shoulders on the hollow needle and the nozzle body are disposed downstream of the mouth of the first injection hole cross section.

* * * * *